US008914990B2

(12) United States Patent
Moretto

(10) Patent No.: US 8,914,990 B2
(45) Date of Patent: Dec. 23, 2014

(54) HOPPER STRUCTURE

(75) Inventor: Renato Moretto, Massanzago (IT)

(73) Assignee: Moretto S.p.A. (IT)

( * ) Notice: Subject to any disclaimer, the term of this patent is extended or adjusted under 35 U.S.C. 154(b) by 1212 days.

(21) Appl. No.: 12/370,091

(22) Filed: Feb. 12, 2009

(65) Prior Publication Data

US 2009/0205219 A1 Aug. 20, 2009

(30) Foreign Application Priority Data

Feb. 18, 2008 (IT) ..... VR2008A0024

(51) Int. Cl.

| | |
|---|---|
| ***F26B 3/00*** | (2006.01) |
| ***F26B 17/12*** | (2006.01) |
| ***F26B 19/00*** | (2006.01) |
| ***F26B 17/14*** | (2006.01) |
| ***F26B 9/10*** | (2006.01) |

(52) U.S. Cl.

CPC ..... *F26B 17/1425* (2013.01); *F26B 9/103* (2013.01); *F26B 17/1441* (2013.01)

USPC ..... 34/482; 34/165; 34/218

(58) Field of Classification Search

USPC ..... 34/165, 201, 482, 452, 507, 443, 448, 34/104, 112, 210, 211, 215, 218, 228; 222/71–73, 613, 460, 462, 566; 111/63, 74, 75; 131/44; 193/2 R, 34; 366/341

See application file for complete search history.

(56) References Cited

U.S. PATENT DOCUMENTS

| | | | | | |
|---|---|---|---|---|---|
| 1,547,400 | A | * | 7/1925 | Kimber | 34/174 |
| 2,548,262 | A | | 4/1951 | Hintz | |
| 2,941,310 | A | | 6/1960 | Schaub | 34/65 |
| 3,634,949 | A | * | 1/1972 | Louks | 34/174 |
| 3,875,683 | A | | 4/1975 | Waters | 34/174 |
| 4,004,351 | A | | 1/1977 | Sanneman et al. | 34/52 |
| 4,545,509 | A | * | 10/1985 | Musschoot et al. | 222/198 |
| 4,923,304 | A | * | 5/1990 | Jackson et al. | 366/184 |
| 5,033,208 | A | | 7/1991 | Ohno et al. | 34/168 |
| 5,181,633 | A | | 1/1993 | Weber et al. | |
| 5,505,537 | A | * | 4/1996 | Previero | 366/97 |

(Continued)

FOREIGN PATENT DOCUMENTS

| | | |
|---|---|---|
| BE | 521 178 | 8/1955 |
| DE | 681 774 | 9/1939 |

(Continued)

OTHER PUBLICATIONS

Extended European Search Report mailed Jun. 2, 2009 in corresponding European Patent Application No. 0 915 3015.4-1266.

(Continued)

*Primary Examiner* — Kenneth Rinehart
*Assistant Examiner* — John McCormack
(74) *Attorney, Agent, or Firm* — Ostrolenk Faber LLP

(57) ABSTRACT

A hopper structure for treating granular material, comprising an inner sidewall section arranged, in use, as an upper tubular sidewall, a tapered lower section having a delivery mouth and an elongated insert body wherein said insert comprises an upper portion and a lower portion arranged at said lower tapered portion of the hopper and having its conicity facing away from said upper portion, said upper portion axially extending from the base of the lower portion up to at least one half of the upper tubular section at an angle $\lambda \geq 0$ with respect to a vertical line.

21 Claims, 13 Drawing Sheets

(56) References Cited

U.S. PATENT DOCUMENTS

| | | | | |
|---|---|---|---|---|
| 6,102,562 | A | 8/2000 | Bengtson | 366/341 |
| 6,405,454 | B1 | 6/2002 | Kramer et al. | |
| 7,188,436 | B2 * | 3/2007 | Stock et al. | 34/588 |
| 7,472,494 | B2 * | 1/2009 | Moretto | 34/416 |

FOREIGN PATENT DOCUMENTS

| | | | |
|---|---|---|---|
| DE | 1 556 690 | | 4/1970 |
| DE | 8901136 | | 4/1989 |
| DE | 10 2004 034 293 | A1 | 2/2006 |
| EP | 0 341 196 | A2 | 11/1989 |
| EP | 1 672 302 | A | 6/2006 |
| FR | 1 279 675 | | 12/1961 |
| FR | 1 337 416 | | 9/1963 |
| FR | 1 517 161 | | 3/1968 |
| FR | 1 588 911 | | 3/1970 |
| FR | 2 239 165 | | 2/1975 |
| FR | 2239165 | A * | 3/1975 |
| GB | 240533 | | 10/1925 |
| GB | 1200731 | | 7/1970 |
| GB | 2 015 714 | A | 9/1979 |
| WO | WO 2005/119151 | | 12/2005 |

OTHER PUBLICATIONS

Extended European Search Report for EP 09 15 3015, with mail date of Jun. 2, 2009.

* cited by examiner

HOPPER STRUCTURE

BACKGROUND OF THE INVENTION

1. Field of the Invention

The present invention relates to a hopper structure for containing and treating loose materials, and particularly granular materials, which is equipped with an insert designed to affect the behavior of granular material contained therein, especially during an unloading step.

2. Background Art

The term "hopper" in the present description and in the claims refers to any type of container, both opencast or closed at the top (in which case it is sometimes termed silo), being variously shaped in cross-section, e.g. having a circular, squared or rectangular cross-section, and ending at the bottom thereof with a tapered discharging portion provided with a suitable delivery mouth, usually controlled by a suitable exhaust valve. It is well known that a hopper is generally loaded with loose material at its top portion and the material charged therein is delivered through its delivery mouth at the bottom of its tapered portion.

During an unloading step of the material loaded in a hopper, the downwards flow of loose material can be, in general, of two types: "mass" or "funnel" flow.

When "mass flow" is established, there occurs a uniform descent of all the material inside the hopper with no formation of preferential paths. Otherwise stated, the moduli of speed vectors of the various granules in the hopper at a right cross-section plane of the hopper are, if not identical, very similar to one another.

When "funnel flow" is established, there is, instead, non-uniformity in the values of speed vector moduli of the various granules along a hopper's right cross-section. More particularly, speed vector moduli at the central portion of the hopper at the same cross-section have a clearly greater value than the speed vector moduli of granules close to the hopper sidewalls. This phenomenon is indicative of the fact that at least one descending preferential path has been established in the material at least at the central portion of the hopper.

In many applications where a hopper is used as a treatment chamber for a granular material, e.g. in the processing of plastic materials reduced into granules (where "granules" is intended also to include flakes, scales and the like), it is essential to be able to guarantee a "mass flow" descent of the material loaded therein.

It is well known that, in processing many plastic materials, a very important treatment is the dehumidification of plastic material granulates, i.e. the removal of the water from within the granules of the polymeric materials termed "hygroscopic". The removal of humidity from hygroscopic granules is necessary because, during melting of granular material being processed at relatively high temperature, any water possibly remaining within granules can slip into the polymer molecular chains, thus breaking them. Chain breaking results in a final product having much less than optimum mechanical characteristics because even blisters, blowholes, non-homogeneous coloring and other undesired phenomena often occur.

Granular plastic materials to be dehumidified are typically stored in hoppers or silos that are set in fluid communication with a hot and dried air generating device, generally termed "dryer", that is designed to blow hot and dried air (processing air) into the hopper. Once inside the hopper, the processing air flows through the whole mass of granules of plastic material to be dehumidified, or part of it, removes humidity therefrom and comes out the hopper through a suitable outlet duct.

Reaching the desired dehumidification degree in a given granular plastic material, that will subsequently undergo melting in a processing machine (press) depends upon many factors. One of the most important factors is undoubtedly the dwelling time of the granular material in the dehumidification hopper. Depending on the dehumidification degree required for a given granular material to be treated, granules of plastic material have to be stored in the hopper for a determined and specific time interval (dwelling time).

In order to obtain homogeneous drying of a given plastic granular material loaded in a hopper, assuming the air to be distributed in a homogeneous way inside the hopper, the granular material must dwell inside the hopper for a dwelling time which is, in general, specific and typical for each plastic material.

The objective of ensuring the same dwelling time inside the hopper for all granules of a material, implies that, while the granular material descends in the dehumidification hopper, vertical components of the granule speed field are constant on the whole right cross-section of the hopper. As stated above, this type of flow is what is referred to as "mass flow" in the technical literature.

On the contrary, those flow configurations which are responsible for slowing down, or forming accumulations of granular material close to the hopper sidewalls (funnel flow), and causing accelerations in other more central areas of the hopper are to be avoided. A flow configuration of this type leads to the formation of plastic granules which have humidity values that differ from one another, and once fed into a processing machine (press) leads to products of poor quality.

In order to ensure a descending flow as much as possible of the "mass flow" type, it has already been suggested to provide a central conical insert member (with conicity facing upwards) in the hopper at the upper part of a lower tapered portion of the hopper or an elongated tubular insert, like that disclosed and illustrated in U.S. Pat. No. 6,405,454 (Kramer et al.). It is a foraminated insert closed at the bottom thereof and fed with hot and dried air at its top portion, and thus the air does not reach the whole mass of granular material loaded in the hopper. Moreover, under such an insert and above the hopper delivery mouth a "dead" zone is formed which is not reached by dried treatment air where granules, owing to a consequent drop in temperature, may absorb humidity, thereby affecting the physical-chemical characteristics of the product obtained once the granules are processed (moulded). In addition, an undesired "funnel flow" is generated in the dead zone during the discharge step, which results in the granules being mixed up again.

SUMMARY OF THE INVENTION

The main object of the present invention is to provide a hopper or silo structure for drying granular material loaded therein, suitable for controlling the descending flow of material in the hopper, particularly at the bottom discharging portion of the hopper.

Another object of the present invention is to provide a hopper structure for dehumidifying or drying a granular material loaded therein, the hopper structure being designed so that the granular material loaded therein descends therein for a descending time equal or close to the theoretical optimum dwelling time for that specific material in the hopper.

These and other objects, that will better appear below, are attained by a hopper structure for processing granular material, which comprises an inner sidewall section arranged, in use, as an upper tubular sidewall, a tapered lower section having a delivery mouth and an elongated insert body, characterized in that said insert comprises an upper portion and a lower portion arranged at said lower tapered portion of the hopper and having its conicity facing away from said upper portion, said upper portion axially extending from the base of the lower portion up to at least one half of the upper tubular section at an angle $\lambda \geq 0$ with respect to a vertical line.

BRIEF DESCRIPTION OF THE DRAWINGS

Further features and advantages of the present invention will be better apparent from the following detailed description of some currently preferred embodiments thereof, given by way of not limiting examples with reference to the accompanying drawings, in which.

In the accompanying drawings, equal or similar parts or components are indicated by the same reference numerals.

DESCRIPTION OF THE PREFERRED EMBODIMENTS

Figures 1A, 1B:
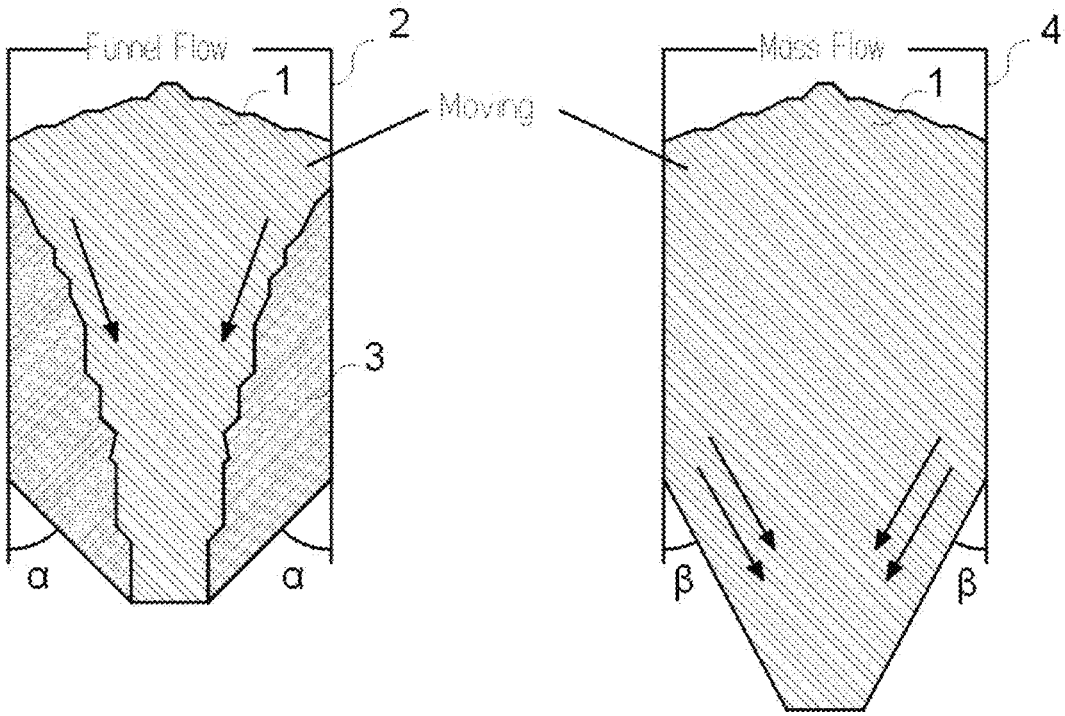
Fig. 1a (prior art)
Fig. 1b (prior art)
FIGS. 1*a* and 1*b* schematically show two types of flow (funnel flow and mass flow) of granular material while descending in a hopper or silo.
Figure 2:
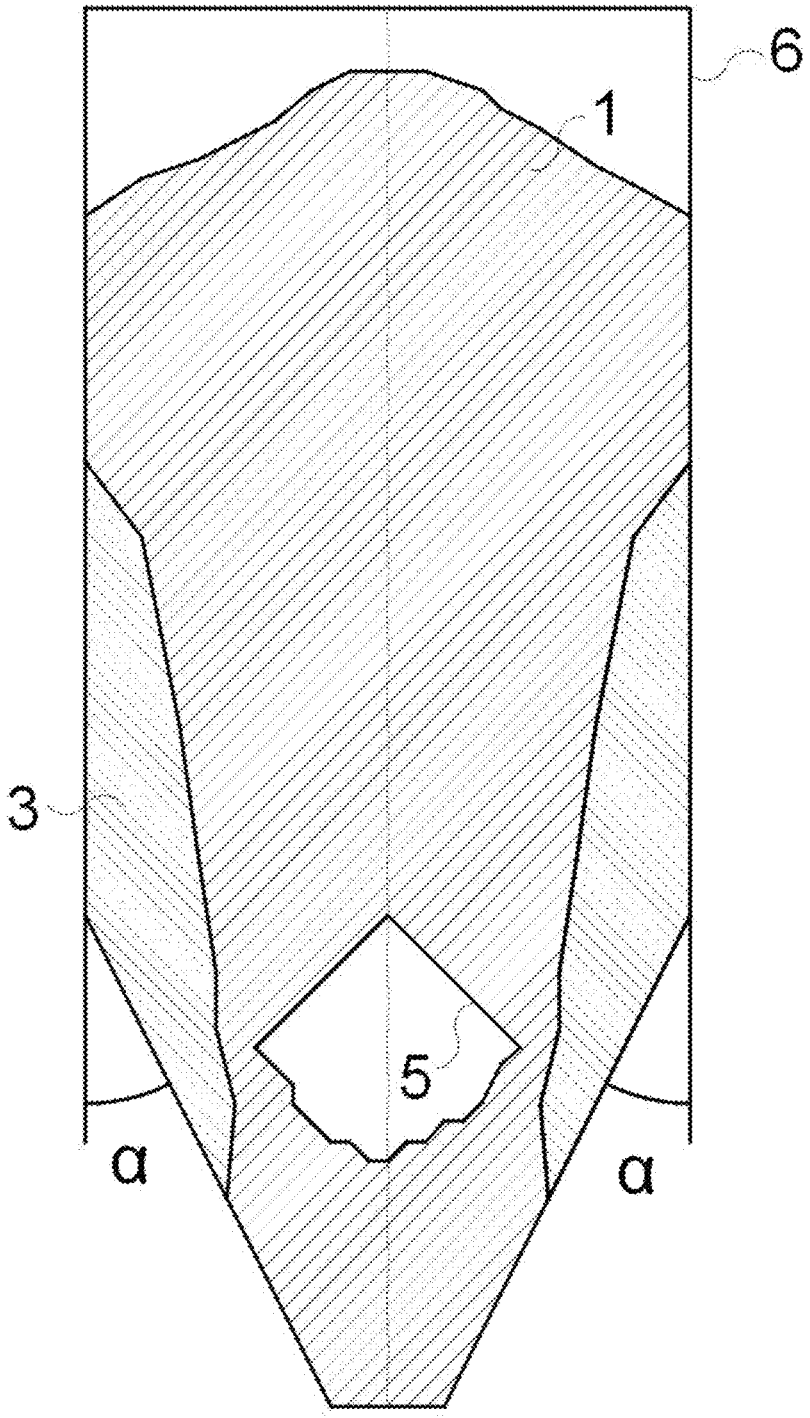
Fig. 2 (prior art)
FIG. 2 schematically shows the behavior of a granular material flow while descending in a hopper in which an insert is provided in a known manner which is shaped as an axial conical member located at the lower tapered portion of the hopper.

With reference first to FIGS. 1*a*, 1*b* and 2, it will be noted that the behavior of a granular material 1 while descending in a dehumidification or drying hopper or silo 2, 4 and 6 is essentially of two types, i.e. the so-called "funnel flow", or the "mass flow". According to a theoretical model disclosed by Jenike in text: "Statics and Kinematics of granular material" by R. M. Nedderman, published by Cambridge University Press, the behavior of a granular material while descending inside a hopper or silo essentially depends upon the flowing capability of the granules in the hopper. (Rheological) Parameters that affect the flowing capability are fundamentally two, that is the internal friction angle which is typical for a given granular material and the friction angle with the hopper sidewall, which is also typical of a specific granular material. The friction angle with the hopper sidewall is the inclination angle at which a granular material starts flowing downwards inside the hopper due to its weight.

These two parameters, in turn, tightly depend first on the nature of the plastic granular material, on shape (configuration) of the granules, on the type of material the hopper or silo is made of, and from numerous other imponderable factors.

From Jenike's known theory, depending upon the angle $\alpha$, that the inclined (tapered) sidewall or one of the sidewalls of the lower section of the hopper forms with a vertical line, and depending upon the above mentioned rheological parameters, it is possible to assess with good approximation if a given material will descend in a hopper in accordance with a "mass" or "funnel" flow.

According to Jenike's theory, if angle $\alpha$ of the lower tapered sidewall of hopper 2 is too large, a preferential central downfall channel is formed in the granular material 1 (FIG. 1*a*). The granular material close to the vertical sidewall 3, even quite a lot above the lower tapered section of hopper 2, descends at a remarkably lower speed than the granular material in the central channel (funnel flow). Stagnant zones can even form about the central channel, where the granular material does not move downwards at all, i.e. it is permanently at a standstill.

In the hopper 4 of FIG. 1*b*, the tapering angle $\beta$ is, instead, smaller than the angle $\alpha$ of hopper 2. This results in a descending flow of granular material of "mass flow" type, that is all the material flows downwards at a substantially constant speed with respect to any right cross-section of the hopper 4.

According to classical Jenike's theory, in order to have a uniform descending flow of granular material it is then necessary to choose the tapering angle of the lower section of the hopper in accordance with the rheological properties of the granular material. As a matter of fact, Jenike's theory is useful for estimating in advance the formation of stagnant zones 3, where the material is facing great difficulty in flowing downwards. It is, however, necessary to take into account that in the case of a dehumidification plant a hopper or silo is used to dehumidify various kinds of granular material having rheological properties that differ from one another.

The solution consisting in dimensioning the hopper tapering angle based on the rheological properties of the granular material to be processed in order to ensure a material flow of "mass flow" type, is thus unfeasible at least from a practical viewpoint.

In the state of the art also other solutions have been proposed aimed at having an effect on the behaviour of the flow of a granular material in a hopper, and possibly at changing from "funnel" to "mass" flow. For instance, a conical deflecting insert 5 with conicity facing upwards and axially arranged within the hopper at the tapered lower section of the hopper 6 may be used (FIG. 2). The function of the deflecting insert 5 is that of slowing down the central descending flow of the granular material 1. This solution, however, is not sufficient to ensure a really uniform descending flow of the granular material 1. The granular material, at an annular peripheral portion in the zone between tapered sidewall or sidewalls and vertical sidewall or sidewalls of the hopper 6, flows downwards at a much lower speed than the granular material in the central portion. In a dehumidification hopper this phenomenon can result in an undesired mixing of granules having different humidity levels, which is very undesirable, because, as already stated, the remixing affects the properties of articles obtained from granular material thus dehumidified.

Figures 3A, 3B, 3C:
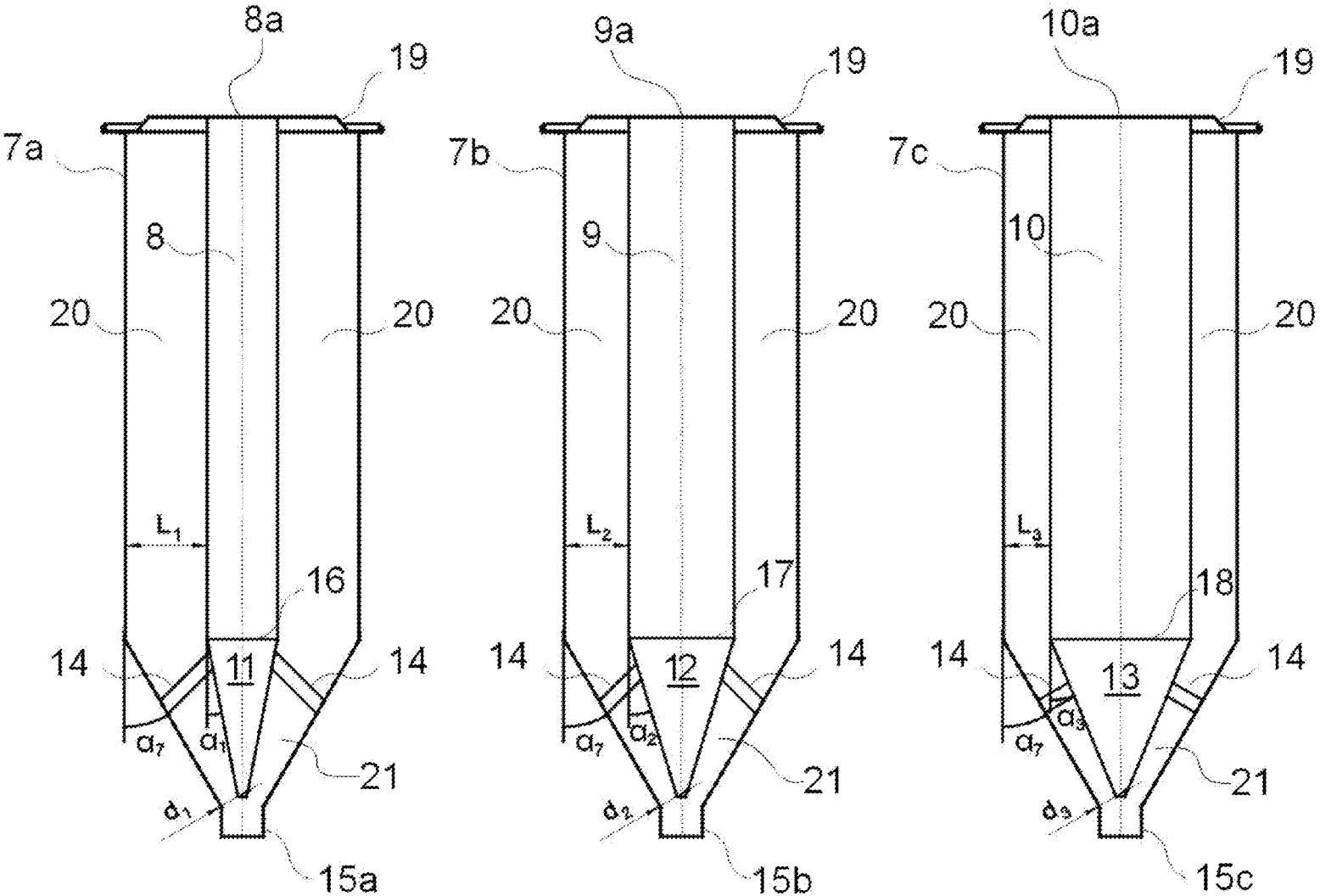
FIGS. 3*a*, 3*b* and 3*c* schematically show a hopper structure according to the present invention comprising an axial insert substantially extending throughout the whole height of the hopper and being of varied size.

In the embodiments of the present invention illustrated in FIGS. 3*a*, 3*b* and 3*c*, three hoppers or silos 7*a*, 7*b* and 7*c* circular in cross-section are equipped with a, preferably hollow, insert 8, 9 and 10, respectively, located therein and extending preferably axially from the top of its respective hopper throughout the entire upper section having uniform cross-section (cylindrical) and ending at the bottom with a conical (downwards) tapered section 11, 12 and 13, respectively, that leads to a zone just above the lower delivery mouth, 15*a*, 15*b* and 15*c*, respectively, of its respective hopper. The conical or tapered lower section 11, 12 and 13 of each insert 8, 9, and 10, respectively, has a base 16, 17 and 18, respectively, having the same outer diameter as the respective cylindrical upper section.

With such a structure, in hoppers 7*a*, 7*b* and 7*c*, an annular (cylindrical) gap 20 is delimited between the inner sidewall of the hopper and the outer sidewall of the insert, the gap being substantially co-extensive with the upper cylindrical section of the hopper and ending downwardly with a conical gap having a tapered length 21 leading immediately above a delivery mouth 15*a*, 15*b* and 15*c*, respectively.

From a constructional point of view, each hollow insert 8, 9 and 10 is engaged at the top (cover) 19 of its respective hopper and can be held axially positioned by one or more spacers or bearings 14, typically located between the two conical portions of the hopper and the insert, respectively. If desired, at the cover 19 the insert 8, 9 and 10 has an opening 8*a*, 9*a* and 10*a*, respectively, for the inlet of hot and dried air coming from a dryer, as will be further discussed with reference to FIG. 4.

In the dehumidification process of the granular material, granular material to be dehumidified is loaded through one or more inlet mouths (not shown in the drawings) provided at the top of each hopper 7*a*, 7*b* and 7*c*, either in the cover 19 or immediately below it, at its annular gap 20, until a pre-determined level is reached inside the hopper, while the respective delivery mouth 15*a*, 15*b*, and 15*c* is closed. Usually, the delivery mouth, in use, is in communication with a underlying screw conveyer of any suitable kind, which is designed to continuously take away amounts of granular material that are a function of the dwelling time $t_r$ of the specific granular material being treated in the hopper. In other applications, the delivery mouth is opened and closed in successive steps to discharge each time an amount of dehumidified material that is equivalent to a feeding batch for a granular material processing machine (press). Suitable feeding of dehumidified granular material is thus ensured for the processing machine. The cyclic opening-closing frequency of the delivery mouth is related to the dwelling time $t_r$ which is specific for each plastic granular material to be dehumidified. A respective batch of granular material to be treated is fed at the hopper top at the same time.

The provision of the hollow insert 8, 9 and 10 in a hopper structure according to the present invention makes it possible to control the descending flow of granular material in the hopper, in such a manner as to obtain substantially uniform descending speed for all granules at the same right cross-section plane of the hopper with no formation of preferential paths or stationary zones of granular material in the hopper.

Inserts proposed so far in the art make it possible to control the descending flow only at the tapered lower section of the hopper, which is inadequate and insufficient to obtain a uniform descending flow along substantially the entire length of the hopper or silo, or allow the flow to be controlled in the upper section of the hopper, while allowing the formation of a dead zone above the delivery mouth, as already discussed.

Thus for example, by providing a conical insert 5 having its conicity facing upwards (FIG. 2) according to conventional structures, a "funnel flow" state occurs in the hopper—as above described. Otherwise stated, a constant descending speed is, therefore, not obtained for all granules located at the same level in the hopper. The flowing capability of a granular material mainly depends, as already stated, on its rheological properties, such as its internal friction angle and the friction angle with the hopper sidewall or sidewalls. It will be understood then that, without the upper tubular (cylindrical) constant cross-section sidewall of the insert, the material dwelling in the central upper section of the hopper is affected only by the internal friction. The speed vectors of the descending granules at a right cross-section of the hopper cannot remain constant, and show a great variety of modular values for their speed vectors between granules in the central portion of the hopper and those located close to the hopper sidewalls.

By using, instead, a hollow insert 8, 9, and 10 shaped according to the disclosure of the present invention, speed vectors of the descending granules at different right cross-sections of the hopper remain substantially constant at each right cross-section of the hopper.

The size of the insert according to the present invention obviously depends on the hopper dimensions and on the type of granular material to be treated.

Given the same hopper dimensions, an insert according to the present invention can have various sizes. The location of an insert 8, 9, and 10 according to the present invention must be such that the minimum distance d1, d2, d3 between the inner inclined sidewall of said hopper 7*a*, 7*b* and 7*c* and the conical surface 11, 12 and 13 of the insert according to the present invention is greater than the "critical distance" which results in an arc or arcs being generated which stop the descent towards the delivery mouth of granular material located above the arc. An empirical relation shows that the critical distance is equal to about 7 times the maximum size of an average granule designed to flow inside the hopper 7*a*, 7*b* and 7*c*.

In the embodiments of the present invention shown in FIGS. 3*a*, 3*b*, and 3*c*, the respective distance d1, d2, d3 has been kept constant, whereas the angle $\alpha$1, $\alpha$2, $\alpha$3, respectively, delimited between the surface of a respective cone 11, 12, 13 having its vertex facing towards the delivery mouth 15*a*, 15*b*, 15*c* and a vertical line, or better the imaginary extension of the upper cylindrical portion of the respective insert 8, 9, 10, has been changed.

The choice of advantageous dimensions for the insert according to the present invention to be located in a granular material treatment hopper depends on a number of factors. Depending on the angle and the minimum distance d1, d2, d3, the inner size dimension of the hopper being maintained constant, different working volumes with respective annular distances $L_1$, $L_2$, $L_3$ are obtained.

Tests performed that will be described below, show that a uniform descending flow of granular material in the hopper is obtained at highest values of angle $\alpha_1$, $\alpha_2$, $\alpha_3$. Best results are obtained, however, with the greatest angle $\alpha_3$ of FIG. 3*c* which is smaller than the tapering angle $\alpha_7$ of the lower sidewall of hoppers 7*a*, 7*b* and 7*c*.

On the other hand, the size being the same, the greater the angle $\alpha_3$ the smaller the annular distance $L_3$, and thus a working volume of annular gap between hopper 7*c* and insert 10 according to the present invention will be smaller than that in the embodiments with angles $\alpha_1$, $\alpha_2$ smaller than $\alpha_3$. For this reason, the size of inserts 8, 9, and 10 according to the present invention will have to be chosen by taking into consideration specific requirements of the type of granular material to be treated, so as to reach a correct compromise between working volume along which the granular material is to flow and desired degree of uniformity of descent of such a granular material in the hopper.

Figure 4:
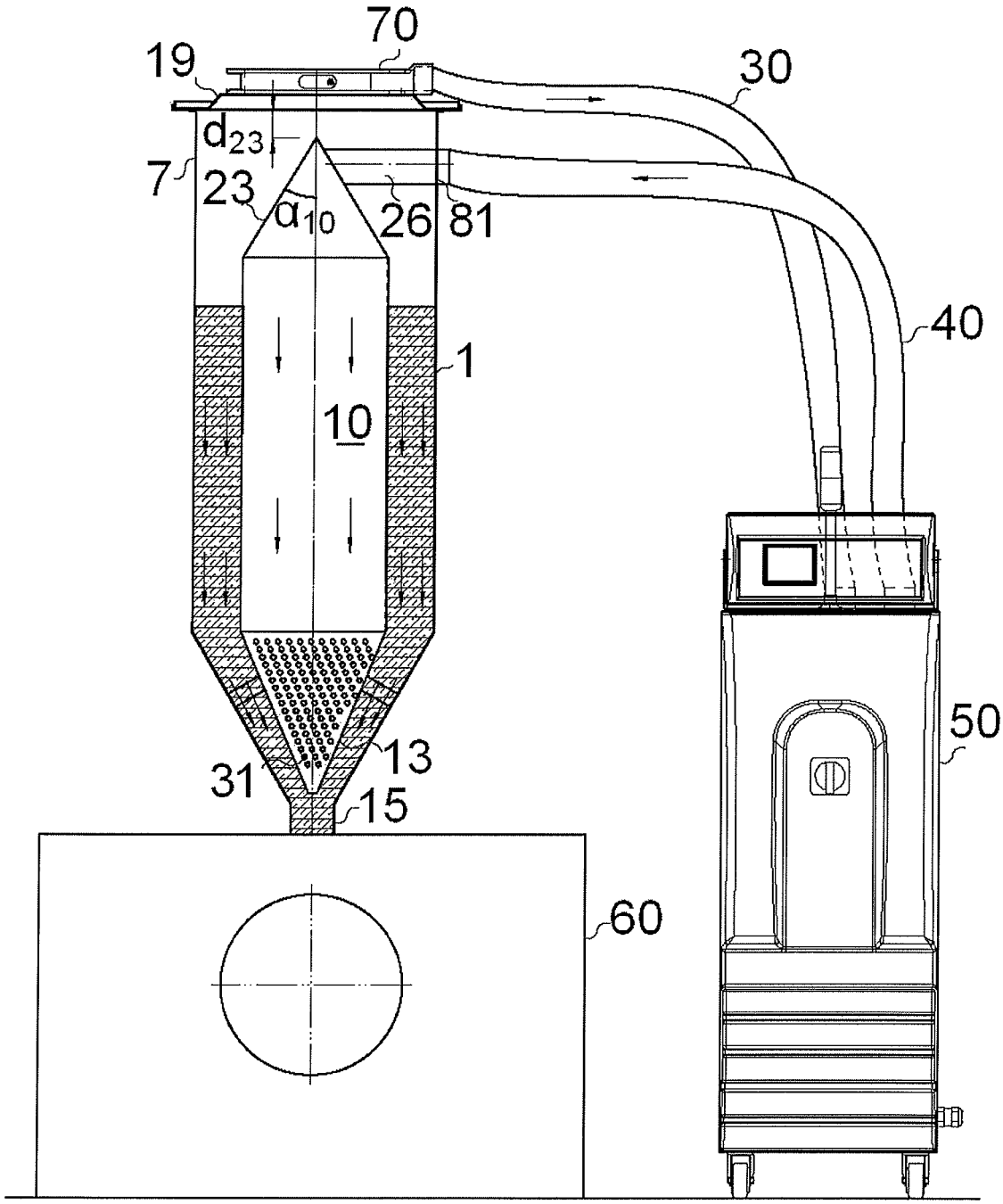
FIG. 4 shows a schematic dehumidifying plant equipped with a dehumidification hopper having an axial insert with conical ends and extending substantially throughout the whole height of the hopper.

FIG. 4 shows an embodiment of a hopper according to the present invention suitable for carrying out dehumidification and/or drying treatment of granular material. In plants for dehumidification and/or drying of plastic granular material, hopper 7 is placed above a processing machine (press) 60. The processing machine 60 is fed with dehumidified and/or dried granular material 1 discharged through the delivery mouth 15 of hopper 7, and it transforms it into a desired product.

Hopper 7 comprises a hollow insert 10 formed by an lower upside-down conical part 13, i.e. having its vertex facing towards the lower delivery mouth 15 of the hopper, an intermediate cylindrical portion and an upper conical portion 23, the lower, intermediate and upper portions being connected to one another in a fluid-tight manner. The lower cone 13 is foraminated, i.e. a plurality of small bores 31 is formed therein, which are designed to spread in the hopper hot and dried processing air coming from a dryer 50. The latter is connected through a duct 40 to an inlet mouth 81 leading to the upper part of insert 10, e.g. at its upper conical part, 23 through a duct 26.

Pressurized processing air from dryer 50 enters the inlet mouth 81, flows along the insert and through the small bores 31 in lower cone 13, thus being diffused in the granular material loaded in the gap between the insert and the internal surface of the hopper, and rising to the hopper top, i.e. from the lower to the upper portion of said hopper 7.

If desired, it is possible to cause the air to come out from the lower portion of cone 13 by truncating its vertex (top). After having crossed the granular material from bottom upwards and reached the hopper top, the exhausted air is forwarded through a suitable air outlet mouth 70 to a duct 30 leading back to dryer 50.

For optimal dimensioning of insert 10, besides the already mentioned variables, also the tapering angle $\alpha_{10}$ between the surface of the upper cone 23 and the axis thereof is to be considered.

Angle $\alpha_{10}$ will be chosen by taking into account the rheological properties of the granular material to be treated. If the value of angle $\alpha_{10}$ is too large, the descending speed of the granular material near the hopper sidewall would become too high with respect to that of the material close to the surface of the upper cone 23.

By applying Jenike's theory, the maximum angle suitable for obtaining a uniform descending flow with a specific granular material can be assessed. Of course, depending on a selected angle $\alpha_{10}$ for the upper cone, if the distance $d_{23}$ between the vertex of the upper cone 23 and the granular material loading mouth 19 is kept constant, then the height of intermediate cylindrical portion of the insert varies. In general, the degree of uniformity of the descending flow of granular material inside the hopper increases when distance $d_{23}$ is reduced.

If, in use, granular material is loaded by batches, i.e. by intermittent loading, into the hopper 7, the height of the intermediate cylindrical portion of insert 10 is preferably such that the junction between cone 23 and the intermediate cylindrical portion of insert 10 is located approximately at the same level as the granular material close to the internal sidewall of hopper 7.

It should be noted, in fact, that a batch of granular material loaded into hopper 7 through the loading mouth 19 falls onto the granular material already loaded therein, thereby forming a cone with an inclination angle that depends on the rheological properties of that granular material.

Thus, in order to achieve uniformity in the descending flow of the granular material, the distance $d_{23}$ will have to be close to zero.

Optionally, for constructional reasons, the upper portion 23 is concave with its concavity facing the intermediate cylindrical portion of insert 10 and has a peripheral circular edge having a diameter equal to that of the intermediate cylindrical portion. More particularly, the upper portion 23 is semispherical, or formed by a truncated cone portion supporting a semispherical portion at the top thereof.

FIGS. 5*a*, 5*b*, 5*c*, 5*d* and 5*e* show five hoppers for granular material processing plants, each having a different insert according to the present invention located therein.

Figures 5A, 5B, 5C, 5D:
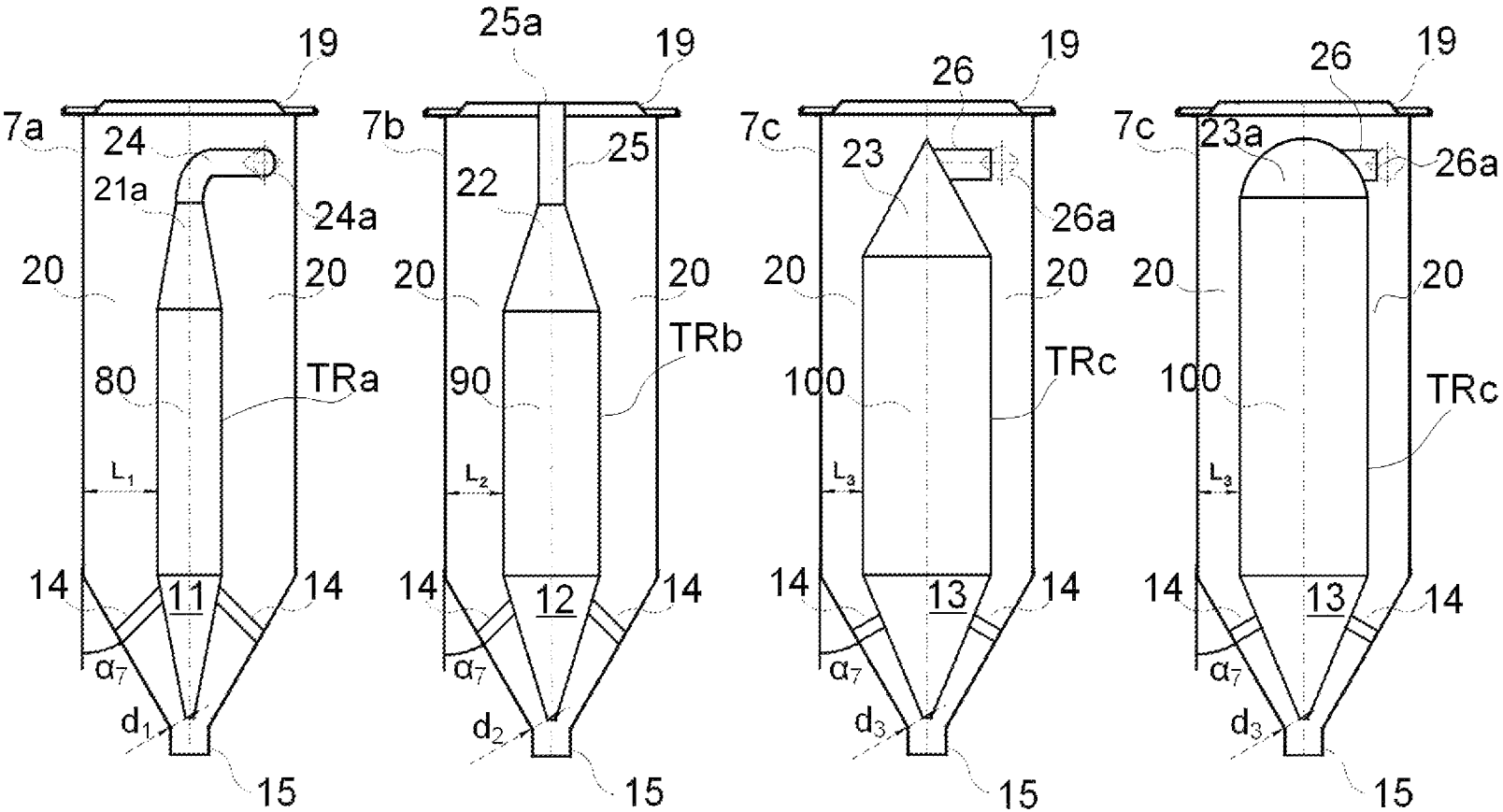
FIGS. 5*a*, 5*b* and 5*c* schematically show different types of insert having conical ends and located inside dehumidifying hoppers according to the present invention.
FIGS. 5*d* and 5*e* diagrammatically show an insert similar to that of FIG. 5*c* having a concave upper portion with concavity facing the lower tapered section of the hopper.

Insert 80 provided in hopper 7*a* of FIG. 5*a* is kept in position at the top thereof by an elbow or double-elbow duct 24. The free end of the elbow 24, which delimits an inlet mouth 24*a* for hot and dried air coming from a dryer (not shown), is held in position and sealingly fitted in a respective opening formed in the hopper sidewall. At its lower portion, the insert is secured through spacers or bearings 14. The elbow duct 24 is sealingly connected at the top to an upper truncated conical part 21*a* of the insert, that also comprises an intermediate cylindrical portion TRa and an upside-down truncated conical lower portion 11. The outer diameter of the intermediate portion TRa is illustrated as being equal to that of the cylindrical portion of insert 8 in FIG. 3*a*, although it could differ from it.

The hollow insert 90 provided in hopper 7*b* is an entirely axially extending insert similar to insert 9 in FIG. 3*b*, since it comprises a lower conical section 12 and an intermediate section TRb. However, hollow insert 90 differs from insert 9 as at its upper portion it has an upper truncated conical section 22 ending with a top axial cylindrical section 25 engaged with cover or lid 19 and delimiting an inlet mouth 25*a* for hot and dried air coming from a suitable dryer (not shown).

Insert 100 provided in hopper 7*c* in FIG. 5*c* is held in position at the top thereof by an elbow or double elbow duct 26. The free end of elbow 26, which forms an inlet mouth 26*a* for hot and dried air coming from a dryer (not shown), is held in position and sealingly fitted into a respective opening formed in the sidewall of hopper 7*c*.

The elbow duct 26 is sealingly connected at the top thereof to an upper truncated conical section 23 of the insert 100 which also comprises an intermediate cylindrical section TRc and an upside-down truncated conical lower section 13. The outer diameter of the intermediate section TRc is equal to that of the cylindrical section of insert 10 in FIG. 3*c*, but could even differ from it.

FIG. 5*d* shows an insert similar to insert 100 in FIG. 5*c*, as it comprises a lower conical portion 13 and an intermediate portion TRc. However, insert 100 in FIG. 5*d* differs from insert 100 in FIG. 5*c* because it terminates at its upper portion with a concave top portion 23*a* having its concavity facing said intermediate portion TRc. The concave top portion 23*a* is semispherical.

Figure 5E:
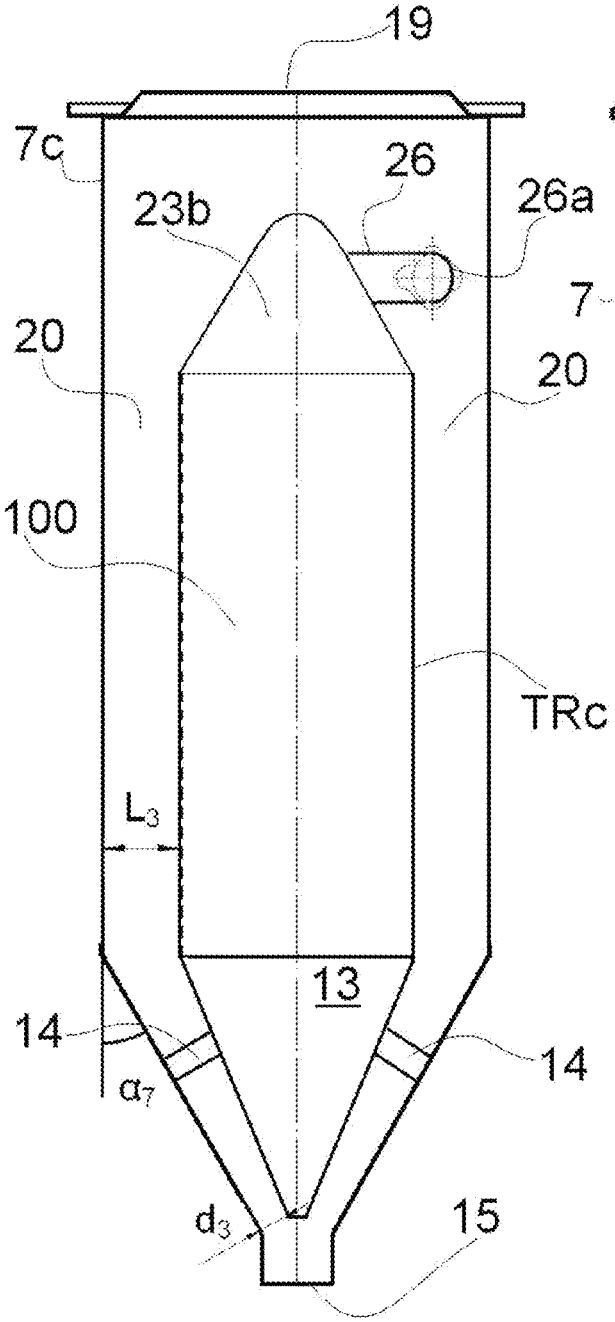

FIG. 5*e*, also, shows an insert similar to that of FIG. 5*c*. In fact, it comprises a lower conical portion 13 and an intermediate portion TRc, the intermediate portion TRc supporting, at its upper portion, a concave top portion 23*b* having its concavity facing downwards. The concave top portion 23*b* is formed by a truncated cone portion supporting a semispherical portion at the top thereof.

Figure 6:
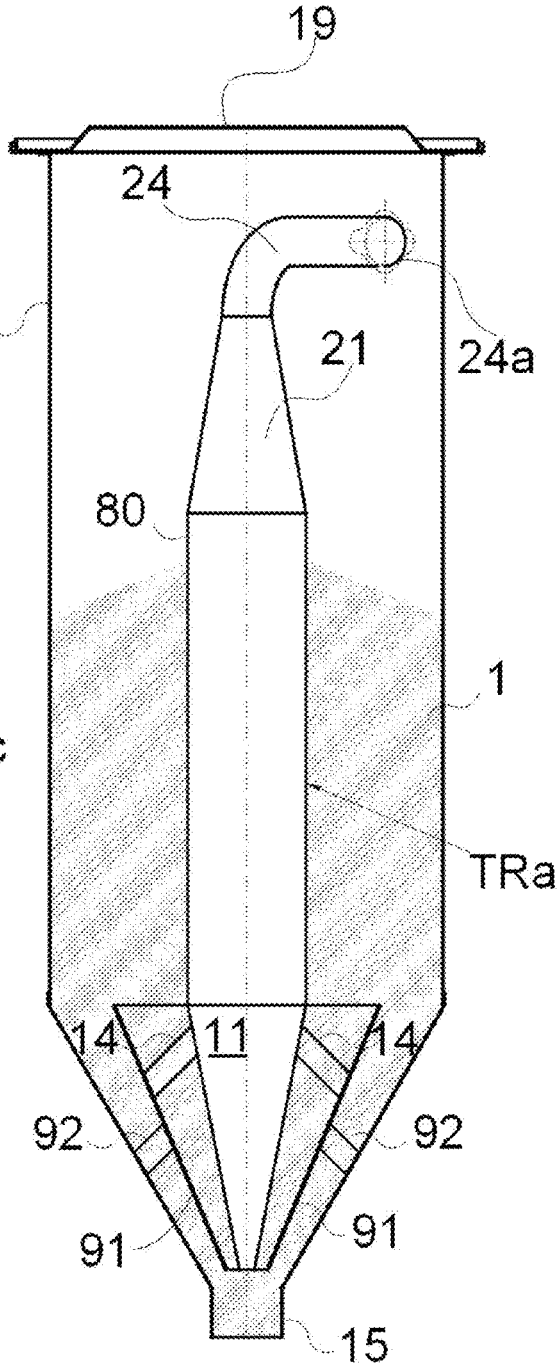
FIG. 6 schematically shows a hopper structure according to the present invention provided with two axial inserts.

FIG. 6 shows a particularly advantageous embodiment of hopper or silo for both granular material dehumidification and/or drying and storage plants. The overall structure of hopper 7 is similar to that illustrated in FIG. 5*a*. In hopper 7 a second hollow insert 91 having the shape of an upside-down truncated cone (i.e. with conicity facing towards the delivery mouth 15) is provided, which is held in position by spacers 14 that support insert 80, and/or advantageously by suitable spacers 92. Insert 80 is, therefore, partly fitted into a second insert 91 and is coaxial with it. The use of such an upside-down truncated conical insert 91 above the delivery mouth is disclosed in U.S. Pat. No. 6,102,562 (Bengtson).

Part of the granular material 1 loaded in the hopper 7 will then flow downwards in the annular space between the surface of lower conical portion 11 of insert 80 according to the present invention and the inner surface of the second truncated conical insert 91, and part of it will flow in the annular space between the outer surface of the second insert 91 and the tapered lower sidewall of said hopper 7.

With such an arrangement of components, inserts 80 of relatively small dimensions can be used, which allows a larger working volume for containing granular material to be available, as well as a substantially uniform descending speed along a right cross-section plane of hopper in FIG. 6 to be obtained.

Advantageously, both the lower truncated conical portion of insert 80 and the second insert 91 are foraminated to allow hot and dried pressurized air from a dryer (not shown), which is supplied to insert 80 through mouth 24*a*, to be also diffused in the annular portion between tapered lower portion of hopper 7 and the second insert 91.

Figure 7A:
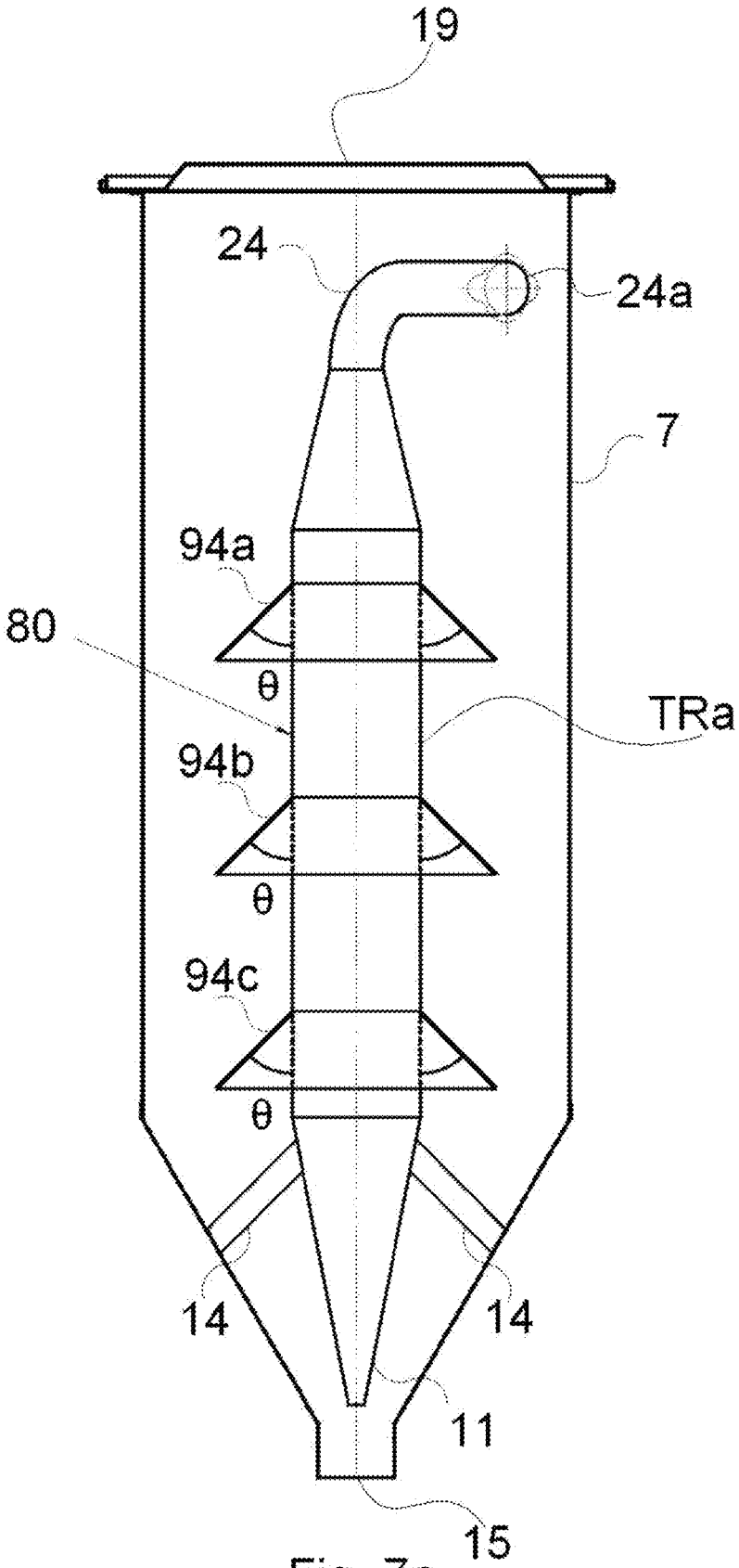
FIG. 7*a* schematically shows another embodiment of a hopper according to the present invention, the hopper having a hollow axial insert provided with a set of truncated-cone finnings at its intermediate section.

Another particularly advantageous embodiment of the present invention is shown in FIG. 7*a*, where the same numerals have been used to indicate components already described with reference to FIG. 5*a*. In hopper 7, which is arranged for a dehumidification or drying plant, an insert 80 according to the present invention is provided. Along the cylindrical portion TRa of insert 80, at different levels, a plurality of (three) hollow truncated conical inserts 94*a*, 94*b*, and 94*c* are provided, which are identical with one another and having a conical shape toward hopper top 19, each insert being located at a predetermined level. The tapering angle θ between the cylindrical surface TRa of insert 80 and the sidewall of each truncated conical insert 94*a*-94*c*, according to Jenike's theory, will preferably have to be smaller than a critical angle, so as to cause discontinuities in the descending speed at orthogonal cross-sections at various levels of hopper 7. The surface portions of the cylindrical section TRa of insert 80 underneath inserts 94*a*-94*c* are preferably foraminated. By adopting this solution, e.g. in a dehumidification plant, the pressurized hot and dried processing air flowing in through the inlet mouth 24*a* can thus be supplied at different levels along hopper 7.

Figure 7B:
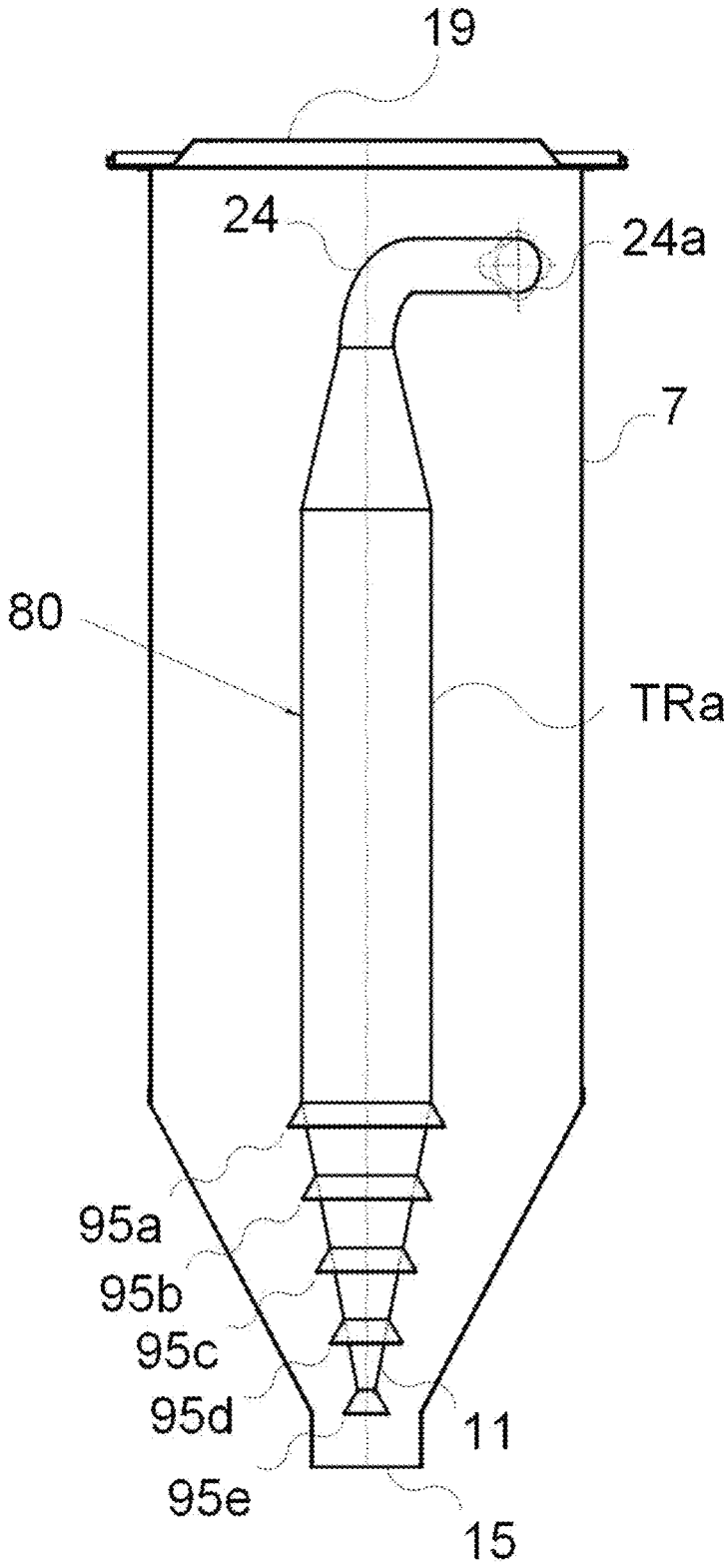
FIG. 7*b* schematically shows another embodiment of a hopper according to the present invention, the hopper having a hollow axial insert provided with a set of truncated-cone-finnings at its lower tapered section.

A further particularly advantageous embodiment of the present invention in shown in FIG. 7*b*, where the same reference numerals have been used to indicate components already described with reference to FIGS. 5*a* and 7*a*. An insert 80 according to the present invention is provided in hopper 7 arranged for a dehumidification or drying plant.

Along conical lower part 11 of insert 80, at different levels, a plurality of hollow truncated conical inserts (five) 95*a*, 95*b*, 95*c*, 95*d* and 95*e* are provided, that have conicity facing towards the hopper top 19 and are secured to lower section 11, so that insert 80 is fitted in the smaller end (facing towards the hopper top 19) of the hollow truncated conical inserts 95*a*-95*e*. Inserts 95*a*-95*e* are so arranged in order to obtain a further improvement in the descending flow of granular material in contact with and/or very close to the sidewall of lower section 11 of insert 80. Close to said section 11, in fact, the moduli of the speed vectors of the granular material are substantially uniform, although slightly greater than those of the granular material not directly in contact or very close to insert 80.

The tapering angle μ formed between a vertical line and the sidewall of each truncated conical insert 95*a*-95*e* must be greater than, or equal to zero, so as to cause the granular material to be treated to slow down during its descent. Should said angle μ be equal to zero, the truncated conical inserts 95*a*-95*e* are cylindrical. The tapering angle μ will be chosen depending on the rheological properties of the granular material to be treated and the desired slowing down of the granular material.

It should be noted that an alternative way of obtaining the slowing down of the granular material in contact or very close to the sidewall of the lower section 11 of the insert according to the present invention is that of making the lower conical section 11 of a material having both a static and a dynamic friction coefficient with the granular material which is greater than both the static and dynamic friction coefficient between granular material and inner sidewall of hopper 7.

Figure 8:
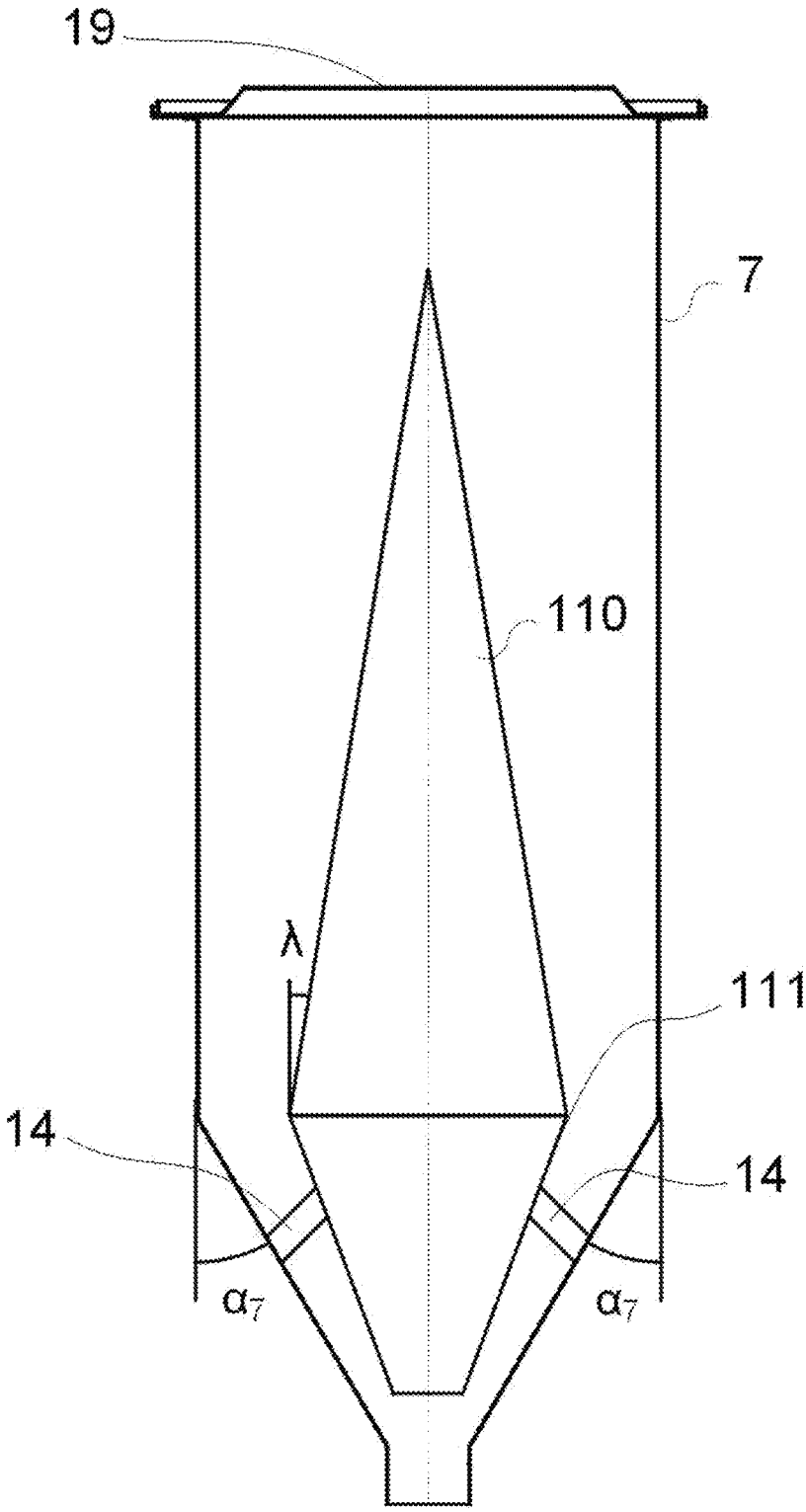
FIG. 8 schematically illustrates a particularly advantageous embodiment of a hopper according to the present invention provided with a biconical insert.
Figure 9:
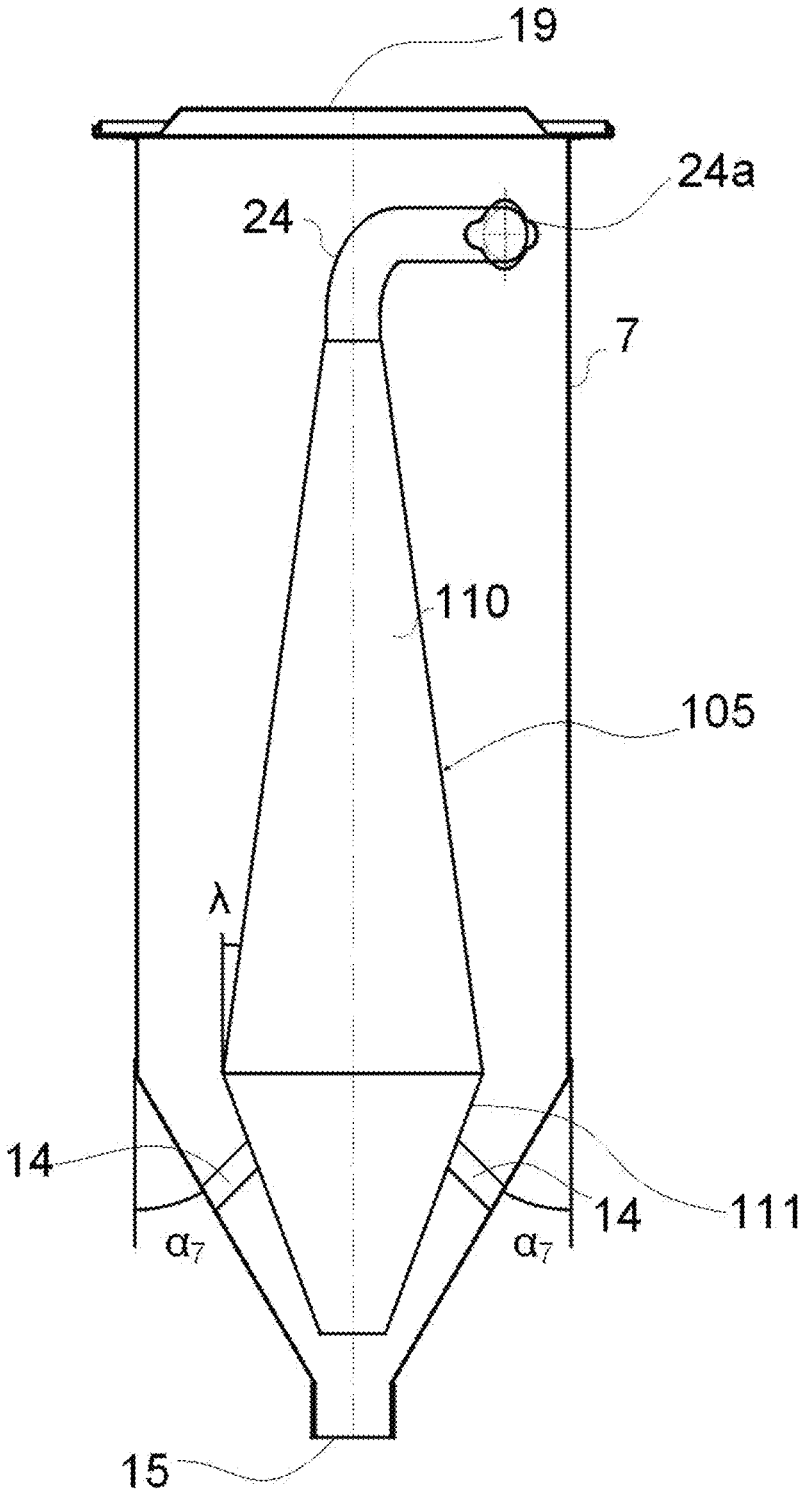
FIG. 9 is a schematic view of an advantageous variation of the hopper structure of FIG. 8.

Further embodiments of a hopper structure according to the present invention are shown in FIGS. 8 and 9. According to these embodiments the insert is formed by two conical or truncated cone sections connected to one another at their bases, i.e. a conical or truncated cone upper section 110 having the vertex thereof facing towards the top 19 of its respective hopper, and a lower truncated cone section 111 arranged, e.g. by means of spacers 14, at the tapered lower portion of the hopper with a tapering angle $\alpha_7$. The height of upper truncated cone section 110 is remarkably greater than lower truncated cone section 111, and thus it has a different conicity with respect thereto. The dimensioning is preferably such that an angle (λ) which is as small as possible is chosen in order to obtain a satisfactory uniformity in the speed of descent of the granular material and an overall insert length equal to at least ½ the hopper height above the lower tapering of the hopper.

Figure 10:
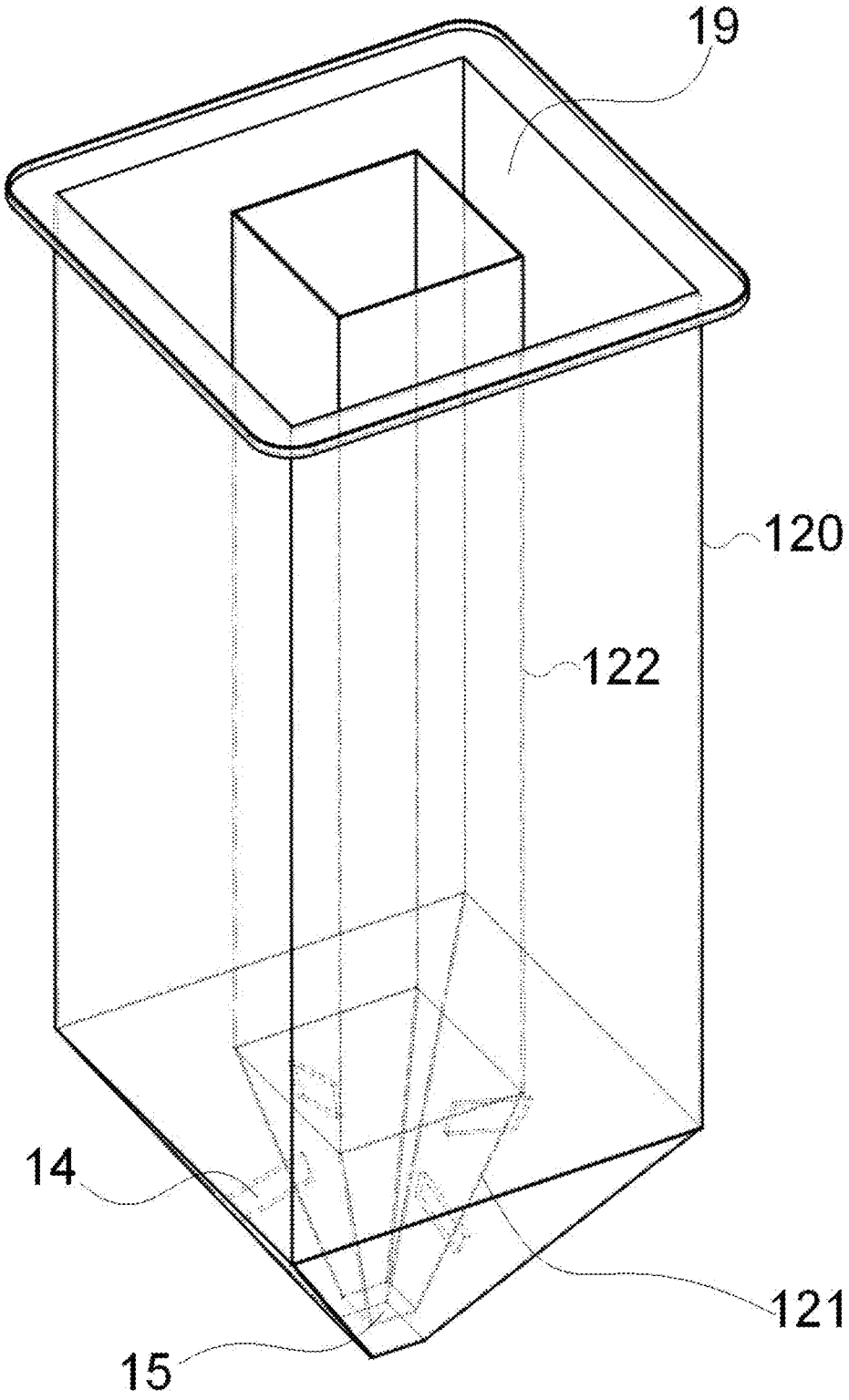
FIG. 10 is an axonometric view of a hopper structure square in cross-section with a hollow insert also being square in cross-section.

In the embodiment of dehumidification hopper shown in FIG. 10, a squared cross-section hopper 120 is shown with a hollow inner insert, also square in cross-section, the insert having a lower truncated pyramid section 121 square in cross-section held in position by spacers 14 and an upper tubular section 122 also square in cross-section which extends up to the top 19 of the hopper. If desired, both the hopper 120 and the insert can be polygonal in cross-section.

Tests were carried out in order to test the efficiency of a hopper structure for dehumidifying granular material according to the present invention.

Figures 11A, 11B, 11C, 11D, 11E:
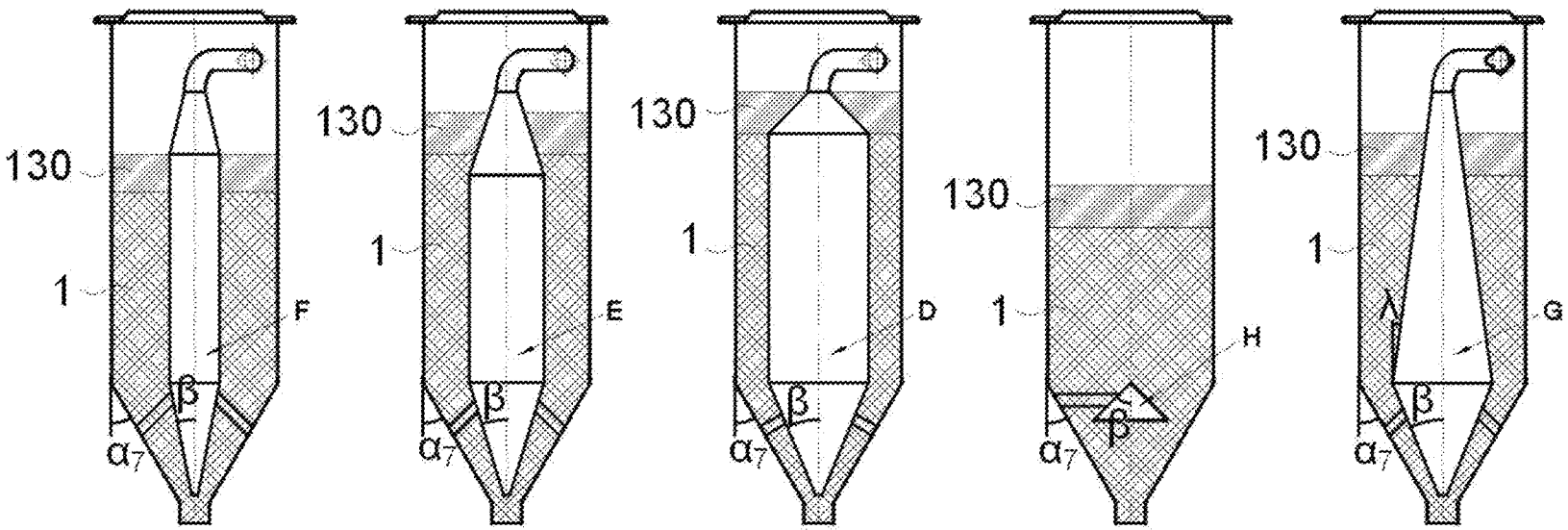
Fig. 11d (prior art)
FIGS. 11*a* to 11*e* schematically show five different types of hopper equipped with various types of insert and loaded with granular material, the hoppers being compared in order to assess the behavior of a descending flow of granular material.

With reference to FIGS. 11*a*, 11*b*, 11*c*, 11*d*, and 11*e*, different shapes of insert D, E, F G as described above and located in a hopper of a given volume were compared with a conventional insert H (FIG. 11*d*). The results are illustrated in a diagram in FIG. 12.

A circular cross-section hopper having an inner volume of 100 liters and a 30° tapering angle $\alpha_7$ at the lower portion of the hopper was used in the tests.

Once the type of hopper had been chosen, an insert according to the present invention was placed therein. A total of about 61 kg of black colored granular material 1 having granular size of about 4 mm was loaded into the hopper working volume. A layer of white colored granular material having substantially the same granular size as the underlying black material 1 was loaded above the black granular material thus loaded, up to a total of about 0.870 kg.

Knowing the hourly flow rate Q of black granular material being unloaded from the lower delivery mouth 15 of the hopper and the total amount P of black granular material dwelling therein, the "theoretical dwelling time $t_r$", which is required for the white granular material to start leaving the hopper, can be reckoned by using a simple algorithm: $t_r=P/Q$.

If the speed of descent is constant throughout an entire hopper cross-section, all the white granular material would be discharged from the hopper being tested in a theoretical dwelling time $t_r$ of 68 minutes.

The actual measurement test was then made by measuring the unloading time of the white granular material. The number of black and white granules coming out of the delivery mouth was sampled every minute starting from the time at which the first white granule was discharged from the delivery mouth 15. The test was repeated, in the same conditions as described above for each of the other three types of insert according to the present invention, as well as with an insert H of conventional type.

Table 1 is provided herein below showing angular properties of the various types of tested inserts.

TABLE 1

| Insert Type | angle β (degrees) | angle λ (degrees) |
|---|---|---|
| D | 22 | 0 |
| E | 17 | 0 |
| F | 11 | 0 |
| G | 22 | 8 |
| H | 34 | — |

Figure 12:
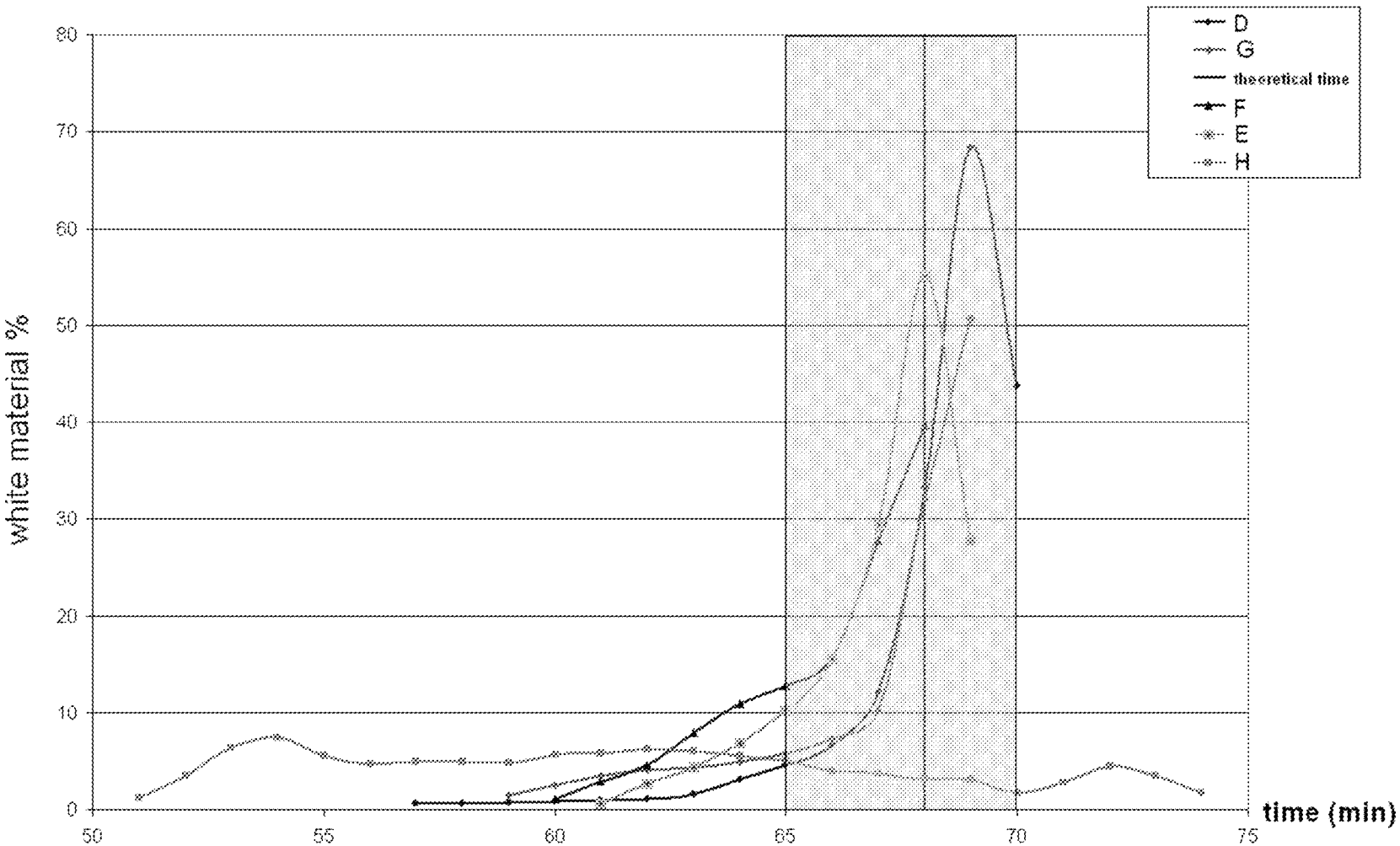
FIG. 12 shows a chart concerning data obtained from experimental analysis of the hoppers of FIGS. 11*a* to 11*e*.

The diagram in FIG. 12 illustrates on the x-coordinate axis the time (t) in minutes from the opening of the delivery mouth 15 and on the y-coordinate axis the percent value of the number of white material granules with respect to the total number of sampled granules (black+white).

As will be noted from the diagram, an insert according to the present invention in the proposed configurations has a positive influence on the descent of granular material in the hopper. As a matter of fact, the large majority of white granules flows downwards within the theoretical time $t_r$. When an insert H of a conventional type was used, the percentage of white material with respect to the total sampled amount does not show any peak, thereby proving that an undesired mixing of black and white materials occurs.

In the following Table 2 the percentages of the amount of white granular material descending within about the theoretical time, i.e. from 65 to 70 minutes (corresponding to the indicated area in FIG. 12), with respect to the total amount of white material (0.870 kg) inside the hopper, is given.

TABLE 2

| Insert Type | White material % |
|---|---|
| D | 78.8 |
| E | 80.4 |
| F | 66.1 |
| G | 62.7 |
| H | 15.3 |

As will be noted from the test results, an insert according to the present invention in the different shapes D, E, F, G remarkably improves the uniformity of descent of granular material with respect to an insert H according to the prior art.

The above described hopper structure equipped with an insert according to the present invention is susceptible to numerous modifications and variations within the scope as defined by the following claims.

The invention claimed is:

1. A hopper structure for treating granular material, comprising an inner sidewall section arranged, in use, as an upper tubular sidewall, a tapered lower section having a delivery mouth and an elongated insert body wherein said insert body comprises an upper portion and a lower portion arranged at said lower tapered portion of the hopper and having its conicity facing away from said upper portion, said upper portion axially extending from the base of the lower portion up to at least one half of the upper tubular section at an angle $\lambda \geq 0$ with respect to a vertical line, wherein said lower portion of the insert body is made of a material having a friction coefficient with respect to granular material, greater than the inner sidewall friction coefficient with respect to granular material.

2. The hopper structure according to claim 1, wherein the friction coefficient of said inner sidewall is smaller than the friction coefficient of said lower portion of the insert body only at said insert body.

3. A hopper structure for treating plastic granular material configured to establish a degree of mass flow in the plastic granular material, comprising an inner sidewall section arranged as an upper tubular sidewall, a tapered lower section having a delivery mouth for said plastic granular material and an elongated insert body, said insert body comprising a fluid tight upper portion and a lower portion arranged at said tapered lower section of the hopper and having its conicity facing away from said upper portion, said upper portion having an exterior surface extending from the base of the lower portion up to at least one half of a height of the upper tubular sidewall at an angle $\lambda \geq 0$ with respect to a vertical line wherein an upper gap for the plastic granular material is delimited between said inner sidewall section and said upper portion of said insert body and a lower conical gap is delimited between said tapered lower section and said lower portion of said insert body;

at least one inlet for hot and dry air to said lower conical gap, said hot and dried air flowing, in use, from said lower conical gap directly to said upper gap through all of said plastic granular material therein contained and towards the top of the hopper structure;

said tapered lower section of said hopper comprises at least one sidewall with a first tapering angle with respect to said vertical line, and said lower portion of said insert body has a second tapering angle with respect to said vertical line, said second tapering angle being less than said first tapering angle; and said degree of mass flow increases as said second tapering angle increases.

4. The hopper structure according to claim 3, wherein the minimum distance between the lower tapered sidewall of the hopper and the surface of the lower portion of the insert body is greater than the "critical distance" which causes the formation of at least one blocking arc in the granular material.

5. The hopper structure according to claim 3, wherein said lower portion of said insert body is foraminated.

6. The hopper structure according to claim 3, wherein said upper portion of said insert body has a cone or truncated cone shape with conicity facing away from its lower portion.

7. The hopper structure according to claim 3, wherein said upper portion of said insert body is tubular with a constant cross-section.

8. The hopper structure according to claim 3, wherein said upper portion of said insert body is tubular with a constant cross-section and terminates with a conical or truncated cone top portion.

9. The hopper structure according to claim 8, wherein the distance between the vertex of said conical or truncated cone top portion and a loading mouth of said hopper is close to zero.

10. The hopper structure according to claim 3, wherein said upper portion of said insert body is tubular with a constant cross-section and terminates with a concave top portion having the concavity thereof facing said upper portion of said insert body.

11. The hopper structure according to claim 10, wherein said concave top portion is semispherical, or formed by a truncated cone portion supporting a semispherical portion at the top thereof.

12. The hopper structure according to claim 3, wherein said upper portion of said insert body is in fluid communication with a hot and dried source of air.

13. The hopper structure according to claim 7, wherein at least one truncated cone projection is provided along the constant cross-section portion of the insert body having conicity facing upwards and being located at a predetermined level therealong.

14. The hopper structure according to claim 13, wherein the tapering angle of each projection is smaller than a critical angle, thereby causing discontinuity in the speed of descent of granular material at various hopper levels.

15. The hopper structure according to claim 3, wherein at least one hollow truncated cone projection is provided along the lower portion of the insert body, each projection having conicity facing upwards and being located at a predetermined level therealong.

16. The hopper structure according to claim 15, wherein a tapering angle of each projection is greater than, or equal to zero, thereby causing a slowing down in the speed of descent of granular material in contact and/or close to said lower portion of said insert body.

17. The hopper structure according to claim 3, wherein said insert body is supported inside the hopper at its lower portion by means of spacers.

18. The hopper structure according to claim 3, comprising an auxiliary hollow insert element having a truncated cone shape having conicity facing the delivery mouth of the hopper and being placed between said lower portion of said insert body and the tapering lower portion of the hopper.

19. The hopper structure according to claim 18, wherein said auxiliary hollow insert element is supported by means of spacers.

20. A method of controlling downward flow of a granular material in a hopper, comprising the steps of: arranging a hopper structure according to claim 8, loading granular material into said hopper, characterized in that said granular material close to the inner sidewall of the hopper is maintained in a quantity approximately reaching the level of the junction between said top portion and said tubular portion of the insert body.

21. A method for treating granular material with a hopper as claimed in claim 3 by establishing therein a mass flow, comprising:

loading plastic granular material in said upper gap;

supplying hot and dried air to said lower conical gap, whereby the hot and dry air rises to the top of the hopper structure; and causing a uniform descent in the hopper structure of said plastic granular material.

* * * * *